US007915512B2

(12) United States Patent
Fratti et al.

(10) Patent No.: US 7,915,512 B2
(45) **Date of Patent: *Mar. 29, 2011**

(54) METHOD AND APPARATUS FOR ADJUSTING THE CADENCE OF MUSIC ON A PERSONAL AUDIO DEVICE

(75) Inventors: Roger A. Fratti, Mohnton, PA (US); Cathy Lynn Hollien, Bridgewater, NJ (US); Arlen R. Martin, Blandon, PA (US)

(73) Assignee: Agere Systems, Inc., Allentown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/288,000

(22) Filed: Oct. 15, 2008

(65) Prior Publication Data

US 2010/0089224 A1 Apr. 15, 2010

(51) Int. Cl.
*G10H 1/00* (2006.01)

(52) U.S. Cl. ..... 84/612; 84/636; 84/652; 84/668

(58) Field of Classification Search ..... 84/668, 84/652, 636, 612, 600–602
See application file for complete search history.

(56) References Cited

U.S. PATENT DOCUMENTS

| | | | | |
|---|---|---|---|---|
| 6,746,247 | B2 * | 6/2004 | Barton | 434/247 |
| 7,254,516 | B2 * | 8/2007 | Case et al. | 702/182 |
| 7,514,623 | B1 * | 4/2009 | Spinler et al. | 84/612 |
| 7,521,623 | B2 * | 4/2009 | Bowen | 84/612 |
| 7,521,624 | B2 * | 4/2009 | Asukai et al. | 84/612 |
| 7,542,816 | B2 * | 6/2009 | Rosenberg | 700/94 |
| 7,603,255 | B2 * | 10/2009 | Case et al. | 702/182 |
| 2002/0155416 | A1 * | 10/2002 | Barton | 434/247 |
| 2005/0070360 | A1 * | 3/2005 | McEachen et al. | 463/42 |
| 2006/0017692 | A1 * | 1/2006 | Wehrenberg et al. | 345/156 |
| 2006/0111621 | A1 * | 5/2006 | Coppi et al. | 600/300 |
| 2006/0136173 | A1 * | 6/2006 | Case et al. | 702/182 |
| 2006/0169125 | A1 * | 8/2006 | Ashkenazi et al. | 84/612 |
| 2006/0220882 | A1 * | 10/2006 | Makino | 340/573.1 |
| 2006/0251386 | A1 * | 11/2006 | Bunya et al. | 386/68 |
| 2007/0074617 | A1 * | 4/2007 | Vergo | 84/612 |

(Continued)

FOREIGN PATENT DOCUMENTS

JP 08234791 * 9/1996

OTHER PUBLICATIONS

U.S. Appl. No. 12/228,197, filed Aug. 11, 2008, "Method and Apparatus for Adjusting the Cadence of Music on a Personal Audio Device".

*Primary Examiner* — David S. Warren
(74) *Attorney, Agent, or Firm* — Ryan, Mason & Lewis, LLP

(57) ABSTRACT

Disclosed is an audio device that adjusts the cadence of played songs. A user sensor determines cadence data based on movement of the user. A desired cadence is determined based on the cadence data received from the sensor. The cadence of songs is determined by low pass filtering digital representations of the songs and determining the period (T) of the back beat of the songs. An adjustment of the period (T) of the songs is then determined such that the adjustment of the period (T) of the songs results in the songs having the desired cadence. The period (T) of the back beat of the subsequent songs are then adjusted.

20 Claims, 6 Drawing Sheets

U.S. PATENT DOCUMENTS

2007/0074618 A1* 4/2007 Vergo ..... 84/612
2007/0074619 A1* 4/2007 Vergo ..... 84/612
2007/0079691 A1* 4/2007 Turner ..... 84/612
2007/0169614 A1* 7/2007 Sasaki et al. ..... 84/612
2007/0180980 A1* 8/2007 Kim ..... 84/612
2007/0186756 A1* 8/2007 Sano et al. ..... 84/612
2007/0193438 A1* 8/2007 Asukai et al. ..... 84/612
2007/0221045 A1* 9/2007 Terauchi et al. ..... 84/609
2007/0254271 A1* 11/2007 Burlik et al. ..... 434/247
2007/0261538 A1* 11/2007 Takai et al. ..... 84/612
2007/0270667 A1* 11/2007 Coppi et al. ..... 600/300
2007/0280489 A1* 12/2007 Roman et al. ..... 381/119
2007/0287596 A1* 12/2007 Case et al. ..... 482/8
2008/0013756 A1* 1/2008 Roman et al. ..... 381/119
2008/0034948 A1* 2/2008 Sumita ..... 84/636
2008/0097633 A1* 4/2008 Jochelson et al. ..... 700/94
2008/0103022 A1* 5/2008 Dvorak et al. ..... 482/3
2008/0126384 A1* 5/2008 Toms et al. ..... 707/102
2008/0153671 A1* 6/2008 Ogg et al. ..... 482/3
2008/0214946 A1* 9/2008 Miller et al. ..... 600/516
2008/0306619 A1* 12/2008 Cerra et al. ..... 700/94
2008/0310579 A1* 12/2008 Boezaart ..... 377/24.2
2008/0314232 A1* 12/2008 Hansson et al. ..... 84/625
2009/0019995 A1* 1/2009 Miyajima ..... 84/625
2009/0024234 A1* 1/2009 Archibald ..... 700/94
2009/0047645 A1* 2/2009 Dibenedetto et al. ..... 434/258
2009/0048044 A1* 2/2009 Oleson et al. ..... 473/570
2009/0048070 A1* 2/2009 Vincent et al. ..... 482/8
2009/0049979 A1* 2/2009 Naik et al. ..... 84/636
2009/0056526 A1* 3/2009 Yamashita et al. ..... 84/611
2009/0088876 A1* 4/2009 Conley et al. ..... 700/94
2009/0133568 A1* 5/2009 Miyajima et al. ..... 84/625
2009/0139389 A1* 6/2009 Bowen ..... 84/636
2009/0157203 A1* 6/2009 Bregar et al. ..... 700/94
2009/0178542 A1* 7/2009 Jochelson et al. ..... 84/609
2009/0205482 A1* 8/2009 Shirai et al. ..... 84/612
2009/0233770 A1* 9/2009 Vincent et al. ..... 482/8
2009/0271496 A1* 10/2009 Nakamura et al. ..... 709/217
2009/0272253 A1* 11/2009 Yamashita et al. ..... 84/611

* cited by examiner

METHOD AND APPARATUS FOR ADJUSTING THE CADENCE OF MUSIC ON A PERSONAL AUDIO DEVICE

BACKGROUND OF THE INVENTION

The present invention relates generally to personal audio devices, and more particularly to adjusting the cadence of music on a personal audio device.

Many people like to listen to music while exercising. In some instances, an improved workout may be achieved if the rhythm of the music is well suited to the cadence of the workout. In order to clearly describe the present invention, several terms are defined as follows. First, cadence is generally used to describe the measure or beat of movement, such as during a march. The regular movement of the marchers defines a cadence. A person exercising may also have a cadence. For example, a jogger will have a cadence defined by his/her feet touching the ground. The regularity of stride of the jogger will define the cadence.

Music may also have a cadence. Each song has certain characteristics. A song's back beat is the regular or periodic pulsation of the music. The back beat of a song is often readily apparent to a listener. Very often, a listener will tap his/her feet or clap his/her hands to the back beat. Music also has a tempo, which is the speed or pace at which the music is played. The period (T) of the back beat is the time duration between the regular pulsations of the back beat. It is noted that the period (T) of the back beat of a song is sometimes referred to herein simply as the period (T) of the song. The period (T) will depend upon the particular song as well as the tempo at which it is being played. As used herein, the term cadence will also be used to describe the rhythmic beat, or pace, of the music. The cadence of a song is generally dependent upon the period (T) of the back beat.

During an exercise session, an improved workout may be achieved if the cadence of the song matches the cadence of the exercise. For example, if the cadence of the song matches the cadence of a jogger, the jogger may be able to run more consistently. In addition, if the cadence of the song is slightly faster than the normal cadence of the runner, the runner may be motivated to run at a faster than normal pace.

A problem arises when a person listens to songs (e.g., in a playlist) during an exercise session where those songs do not match the cadence of the exerciser. In such a case, the exercise routine may be disrupted due to the difference between the cadence of a song and the cadence of the exerciser.

BRIEF SUMMARY OF THE INVENTION

The present invention solves the problem described above by adjusting the cadence of songs played on a personal audio device to match the exercise cadence of an exerciser. This invention may be particularly useful during an exercise routine and may be used to adjust all the songs in a playlist to match the cadence of the exerciser.

In one embodiment, the cadence of the exerciser is determined by receiving cadence data from a user sensor. The user sensor may be, for example, a sensor associated with a user's shoe that can measure the cadence of a jogger by detecting when the shoe impacts the ground. Alternatively, the sensor could be attached to, or part of, an exercise machine being used by a user. A desired cadence is then determined based on the received cadence data. In accordance with one aspect of the invention, the cadence of songs is automatically adjusted by the audio device to match the desired cadence.

In particular embodiments, the cadence of the songs may be determined by low pass filtering digital representations of the songs and determining the period (T) of the back beat of the songs. An adjustment of the period (T) of the subsequent songs is then determined such that the adjustment of the period (T) of the subsequent songs results in the subsequent songs having the desired cadence (i.e., the cadence of the exerciser).

In particular embodiments, the period (T) of the back beat of a song may be increased (which results in a slower cadence), by interpolating a digital representation of the song. Alternatively, the period (T) of the back beat of a song may be decreased (which results in a faster cadence), by decimating a digital representation of the song.

These and other advantages of the invention will be apparent to those of ordinary skill in the art by reference to the following detailed description and the accompanying drawings.

DETAILED DESCRIPTION

Figure 1:
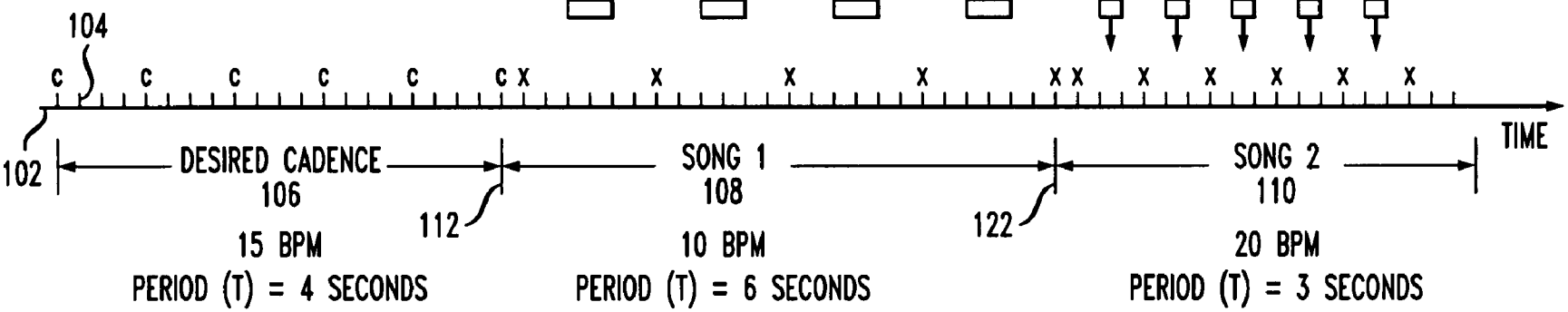
FIG. 1 is a time diagram used to illustrate the principles of the invention.

FIG. 1 is a time diagram which will be used to illustrate the principles of the invention at a high level. FIG. 1 shows a time line 102 with hash marks (e.g., hash mark 104) marked in one second increments. Two songs are also shown, song 1 108, and song 2 110. Also shown as 106 is a desired cadence. The determination of the desired cadence will be described in further detail below in connection with step 404 of FIG. 4. The "C"'s in the figure represent the desired cadence based on a person's exercise. For example, the "C"'s could represent the timing of a jogger's foot impacting the ground. The "X"'s in the figure illustrate the back beat of each song. For example, the desired cadence 106 indicates a desired beat every 4 seconds as shown, because the "C"'s in the figure occur at every fourth time increment hash mark. Thus, the period (T) of the desired cadence is 4 seconds. At this rate, there will be 15 beats per minute (BPM) in the desired cadence. The desired cadence may therefore be defined in terms of the period (T) as the time period between desired back beats. Assume for purposes of this illustration, that at time point 112, song 1 108 begins. As illustrated in FIG. 1, the period (T) of the back beat of song 1 108 is 6 seconds, with 10 BPM. Thus, song 1 has a slower cadence than the desired cadence 106. This could disrupt the person's exercise routine.

In order to solve this problem, and in accordance with an aspect of the invention, the cadence of song 1 is automatically adjusted in order to match the desired cadence 106. In order to accomplish this adjustment, the cadence of song 1 must be increased from 10 BPM with a period (T) of 6 seconds, to 15 BPM with a period (T) of 4 seconds. In one embodiment of the invention, the digital representation of song 1 is decimated, by removing some samples from the digital representation. This is illustrated in FIG. 1 by removing samples 114, 116, 118 and 120 from the digital representation of song 1. If each sample represents a two second time duration, the song will be effectively compressed, so that song 1 will have a period (T) of 4 seconds and 15 BPM.

Similarly, at time point 122, song 1 108 ends and song 2 110 begins. At this transition point, the cadence of the music changes. As illustrated in FIG. 1, the period (T) of the back beat of song 2 110 is 3 seconds, with 20 BPM. Thus, song 2 has a slower cadence than the desired cadence 106. Again, this could result in an undesirable disruption of the person's exercise routine.

In order to solve this problem, and in accordance with an aspect of the invention, the cadence of song 2 is automatically adjusted in order to match the desired cadence 106. In order to accomplish this adjustment, the cadence of song 2 must be decreased from 20 BPM with a period (T) of 3 seconds, to 15 BPM with a period (T) of 4 seconds. In one embodiment of the invention, the digital representation of song 2 is interpolated, by inserting additional samples into the digital representation. This is illustrated in FIG. 1 by inserting samples 124, 126, 128, 130 and 132 into the digital representation of song 2. If each sample represents a one second time duration, the song will be effectively stretched, so that song 2 will have a period (T) of 4 seconds and 15 BPM.

One skilled in the art will recognize that FIG. 1 is an unrealistic real world example, because the songs have large discrepancies between their cadences and the desired cadence (e.g. 15 BPM) may not be accurate for an actual exercise routine. Further, inserting such large portions into the digital representation (e.g., by interpolating), or removing such large portions from the digital representation (e.g., decimating), would cause too much distortion/disruption to the song. FIG. 1 is used solely as a device to explain the high level principles of the invention, while using a straightforward example. A more realistic example of cadence adjustment is as follows.

Assume a desired cadence of 60 BPM with a period (T) of 1 second. Assume song 1 has 64 BPM with a period (T) of the back beat of 0.9375 seconds. In order to adjust the cadence of song 1 to match the desired cadence, the period (T) of the back beat of song 1 must be adjusted (increased) by an adjustment amount of 0.0625 seconds, or 62.5 ms. Assuming that the audio device samples at the rate of 20 KHz, 1,250 samples need to be inserted for every 20,000 clock cycles in order to increase the period (T) of song 1 to match the desired cadence. Thus, an additional sample will be added every $16^{th}$ clock cycle. This process of adding additional samples to the digital representation of the song is called interpolation.

There are various techniques that may be used for the interpolation. In one embodiment, a copy of the prior sample is added as the inserted sample. This may be advantageous where the cadence of the song only requires minimal lengthening. Alternatively, a more complex form of interpolation may be used. For example, the inserted sample may be calculated using one or more prior samples, and/or one or more subsequent samples. Of course, one skilled in the art will recognize that such calculations would require the use of a buffer and appropriate delay circuits in order to perform interpolation based on prior and/or subsequent samples. One skilled in the art would recognize that there are various other interpolation techniques that may be used as well.

As another more realistic example, assume the inverse of the above example. That is, assume a desired cadence of 64 BPM and a period (T) of 0.9375 seconds. Assume song 1 has 60 BPM with a period (T) of the back beat of 1 second. In order to adjust the cadence of song 1 to match the desired cadence, the period (T) of the back beat of song 1 must be adjusted (decreased) by an adjustment amount of 0.0625 seconds, or 62.5 ms. Assuming that the audio device samples at the rate of 20 KHz, 1,250 samples need to be removed for every 20,000 clock cycles in order to decrease the period (T) of song 1 to match the desired cadence. Thus, a sample will be removed every $16^{th}$ clock cycle. This process of removing samples from the digital representation of the song is called decimation.

Figure 2:
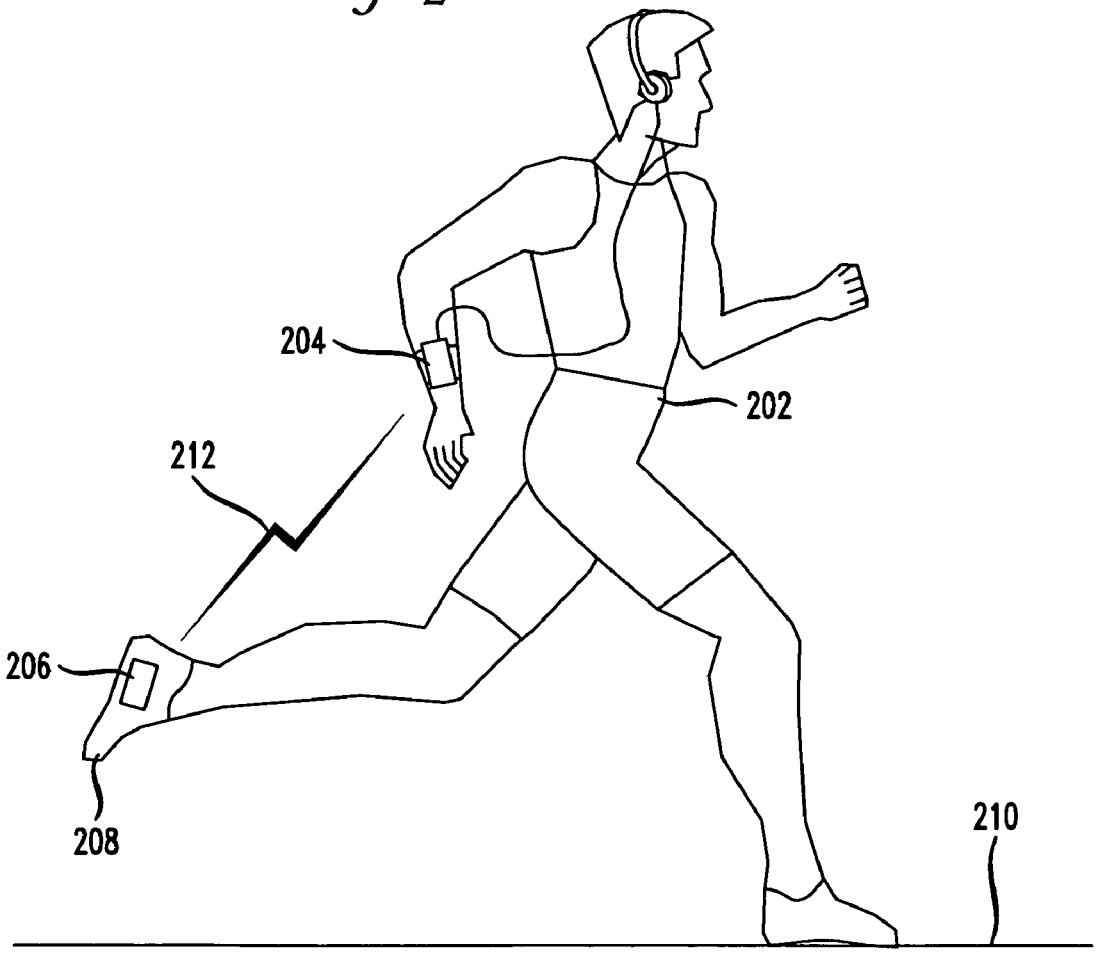
FIG. 2 is a schematic diagram of a user sensor and audio device being used by an exercising user.

FIG. 2 is a schematic diagram of a user sensor and audio device being used by an exercising user. FIG. 2 shows an exercising user 202 using an audio device 204. A sensor 206 is integrated with, or an add-on to, a shoe 208 (e.g., sneaker) of the user. In this embodiment, every time the shoe 208 impacts the ground 210, the sensor 206 detects the impact. In this way, the sensor 206 detects the cadence of the user 202 and can send a wireless signal 212 to the audio device 204 indicative of the cadence of the user. One skilled in the art will recognize that there are various alternative embodiments that are possible in order to detect the cadence of the user 202 and send cadence data to the audio device 204. For example, the sensor could also be a pedometer or other type of sensor. The sensor can also be multiple sensors. In various embodiments, the sensor 206 could send a signal to the audio device 204 each time impact is detected. Alternatively, the sensor 206 could send a signal indicative of the cadence of the user 202, such as a signal identifying the period (T) between impacts, or the sensor 206 could calculate an associated beats per minute (BPM) of the user's impacts. The interface between the sensor 206 and audio device 204 could be a wireless interface 212 as shown, or it could alternatively be a wired interface. One skilled in the art will recognize that various embodiments are possible. For example, the sensor could be integrated with an exercise machine (e.g., treadmill or bicycle), which can detect cadence data based on movement of the machine or parts of the machine. It is only necessary that one or more sensors be able to detect the cadence of the exerciser, such cadence being defined for example in terms of raw data representing the movement (e.g. impact data), the period (T) and/or BPM of some exercise movement of the user, or some other data representing the cadence. Further, the sensor(s) must be able to transmit the cadence information to the audio device.

Figure 6:
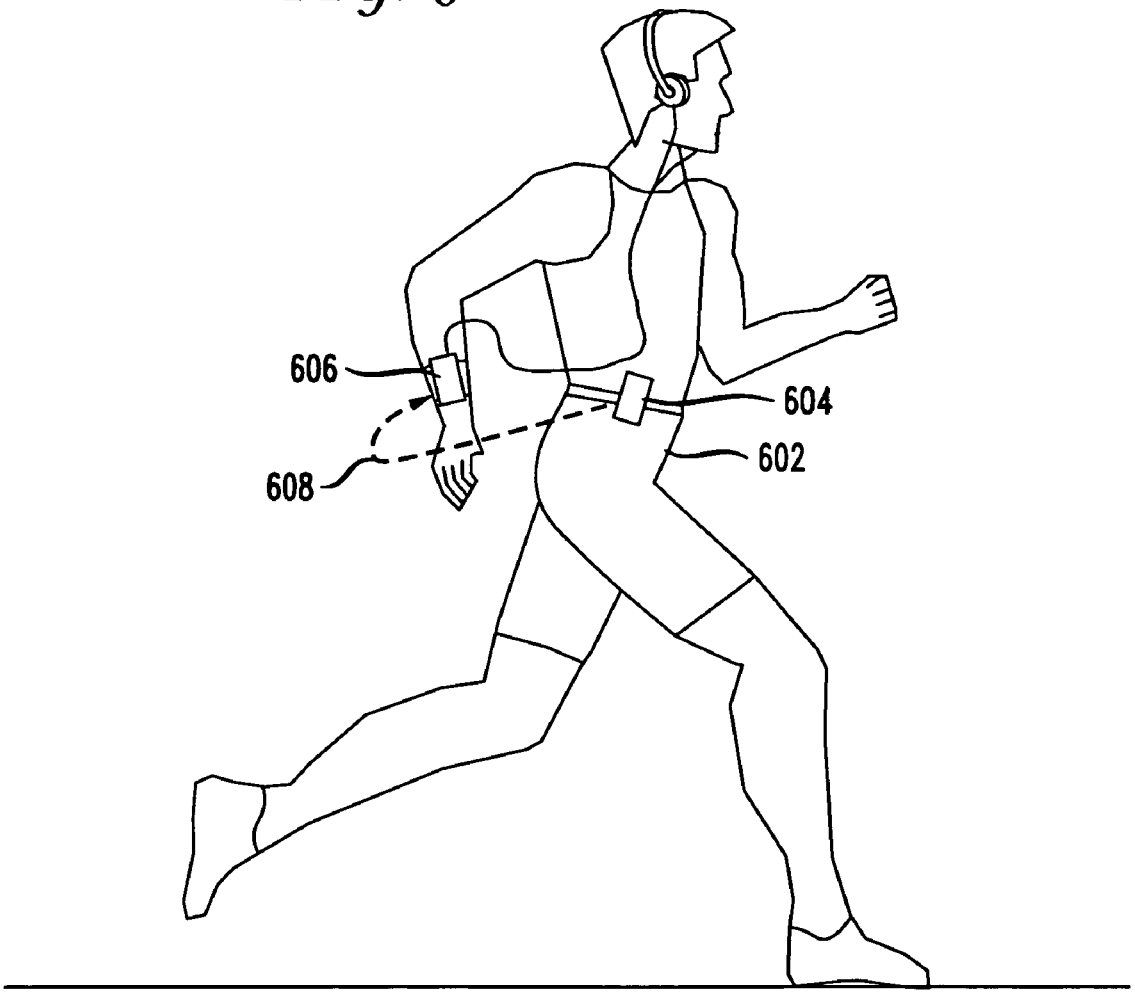
FIG. 6 is an illustration of the device of the invention worn by a user.

FIG. 6 is a schematic diagram of a user sensor and audio device being used by an exercising user in another embodiment. FIG. 6 shows an exercising user 602 using an audio device 606. A sensor 604 is integrated with, or an add-on to, a belt of the user. In this embodiment, as the user moves his or her legs, the sensor 604 detects the movement. In this way, the sensor 604 detects the cadence of the user 602 and can send a wireless signal 608 to the audio device 606 indicative of the cadence of the user.

Figure 7:
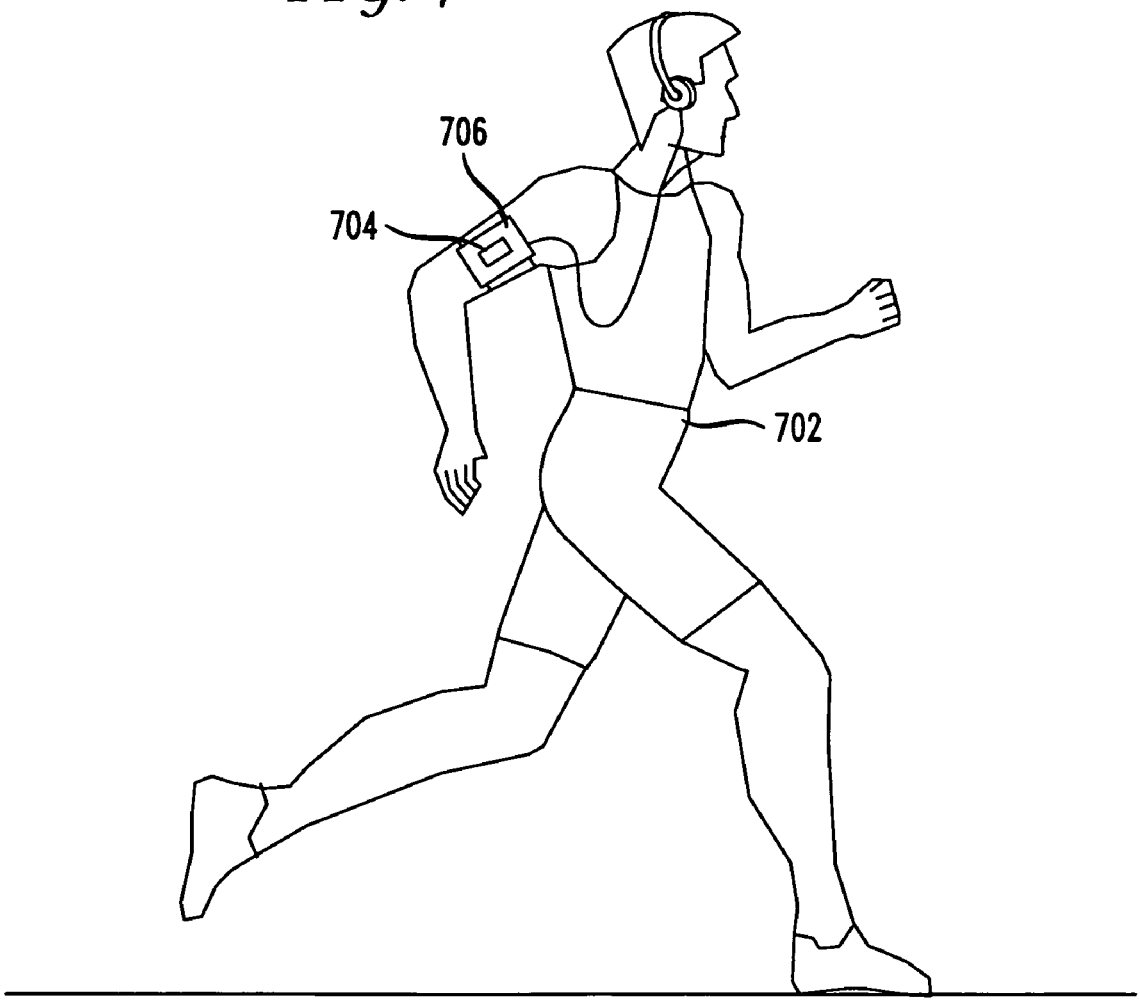
FIG. 7 is an illustration of the device of the invention worn by a user.

FIG. 7 is a schematic diagram of a user sensor coupled to an audio device used by an exercising user. FIG. 7 shows an exercising user 702 using an audio device 706. A sensor 704 is integrated with, or an add-on to, the audio device 706. In this embodiment, as the user moves his or her arm, the sensor 704 detects the movement. In this way, the sensor 704 detects the cadence of the user 702 and can send a signal to the audio device 706 indicative of the cadence of the user.

Figure 3:
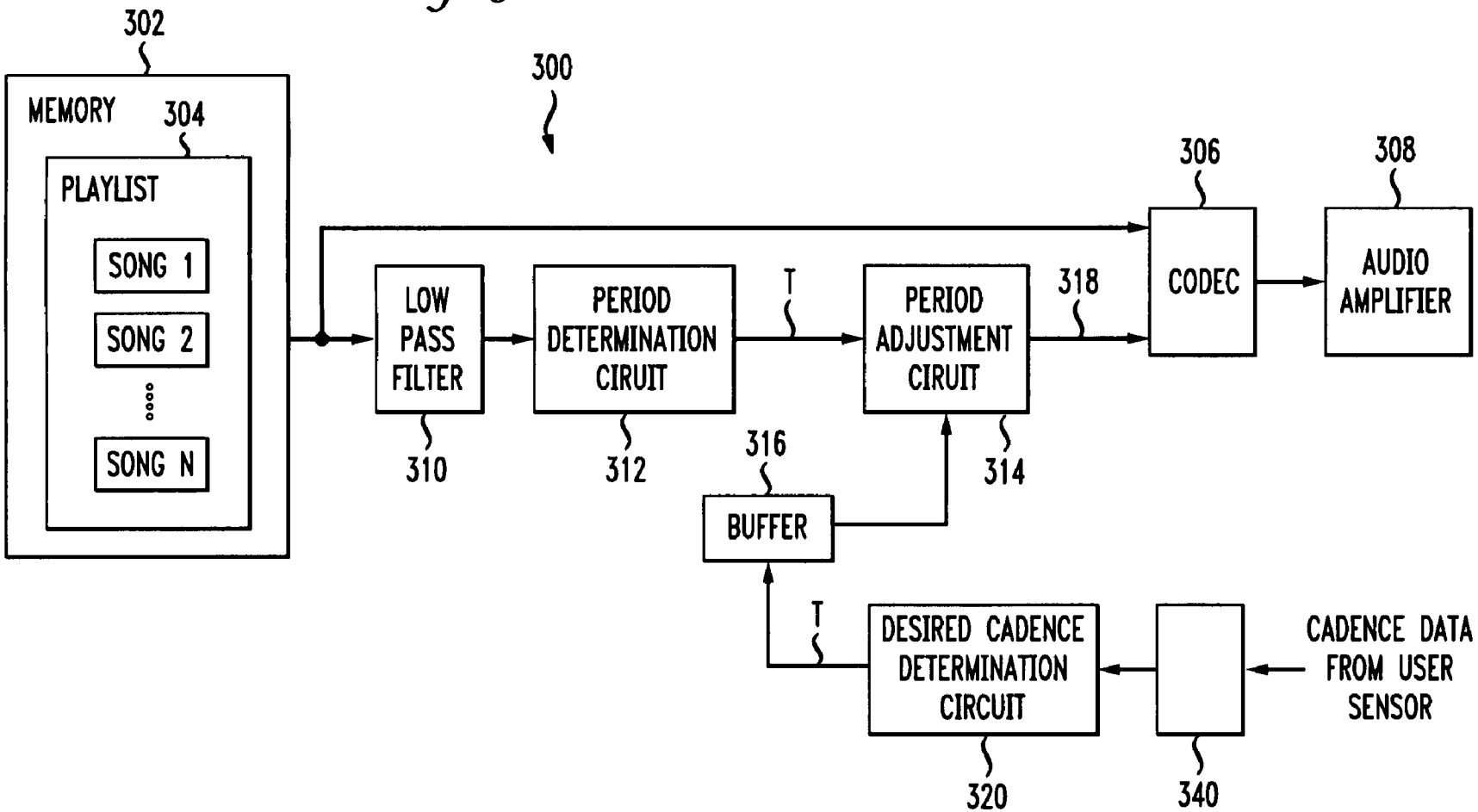
FIG. 3 is a high level block diagram of an audio device configured in accordance with an embodiment of the invention.

FIG. 3 is a high level block diagram of an audio device 300 configured in accordance with one embodiment of the invention. FIG. 3 shows only those components necessary for an understanding of the present invention. One skilled in the art will recognize that certain well known components are not shown. For example, an actual audio device 300 would also include a processor and computer program instructions for controlling various components of the audio device 300. Such computer program instructions would be stored in memory 302, or another computer readable medium, such that the processor could retrieve the instructions and execute the instructions in order to implement the functions of the audio device (e.g., the functions of the flowcharts of FIGS. 4 and 5 as described below). A typical audio device 300 would also include a power source and power circuitry to provide power to the device and its various components. A typical audio device 300 would also include various user interface components (display, buttons, etc.) to allow for user interaction with the device. These additional components are not shown for the sake of clarity. One skilled in the art could readily implement the present invention in an audio device using the description herein.

The audio device 300 includes a memory 302 for storing digital representations of the songs to be played by the device. These songs are typically organized into a playlist 304 comprising a plurality of songs as shown. In a conventional audio device, the digital representation of the songs is provided to a CODEC 306 which decodes the digital representation of the song and provides an appropriate analog output signal to an audio amplifier 308. The audio amplifier provides sound to a user through a speaker, headphone, earpiece or the like.

In one embodiment, the present invention adds a low pass filter 310, a period determination circuit 312, a buffer 316, a period adjustment circuit 314, and a desired cadence determination circuit 320. The audio device also includes an interface 340 for receiving cadence data from the user sensor. For example, in the case of a wireless interface between the audio device and the user sensor, the interface 340 could be an antenna and radio receiver. In the case of a wired interface, the interface could be any appropriate wired interface. Further, the function of the CODEC 306 is modified so that it can perform interpolation and decimation (as described above) in response to a control signal 318 received from the period adjustment circuit 314. While low pass filter 310, period determination circuit 312, buffer 316, period adjustment circuit 314 and desired cadence determination circuit 320 are shown here as hardware blocks and are described as circuits, it should be recognized that, in various embodiments, the functions of these blocks may be performed by hardware, software, or any combination of hardware and software.

Figure 4:
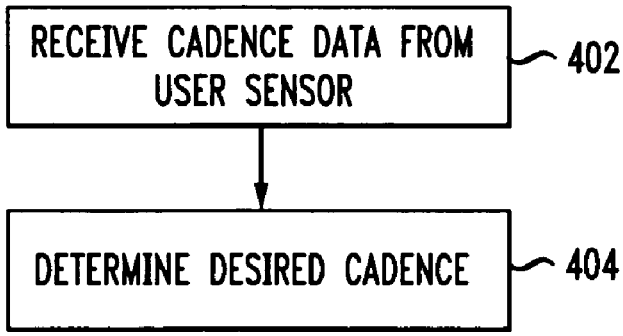
FIG. 4 is a flowchart showing the steps performed in order to determine the desired cadence based on received cadence data from a user sensor.

The functions of the audio device 300 will be described in conjunction with the flowcharts shown in FIGS. 4 and 5. FIG. 4 shows the steps performed in order to determine the desired cadence based on received cadence data from the user sensor. In step 402 the audio device receives cadence data from the user sensor via interface 340. In step 404 the desired cadence determination circuit determines the desired cadence based on the data received from the user sensor. This step may be performed in various ways. For example, the desired cadence may be set to the actual cadence of the user, or some multiple or factor of the user's actual cadence. For example, if the user is exercising at the rate of a slow jog, the user's actual cadence may be only 2 steps per second, which would be a period (T) of two seconds and 30 beats per minute. This exercise cadence may be too slow for a song, so the desired cadence may be set to some multiple of the actual cadence, such as 60 BPM (T=1), 90 BPM (T=0.66), 120 BPM (T=0.5), etc. Alternatively, the exercise cadence may be too fast for a song, so the desired cadence may be set to some factor of the actual cadence in order to slow it down. In addition, the user may prefer a song cadence slightly faster than the user's actual exercise cadence to help motivate the user to increase his/her actual cadence. One skilled in the art will recognize that the determination of the desired cadence based on the sensor data will be dependent upon various things, such as the actual exercise cadence, the type of music being played, as well as user preferences.

After step 404, the period (T) of the desired cadence is stored in buffer memory 316 of the audio device 300. As described above, this period (T) is indicative of the desired cadence, and is used to adjust subsequent songs as described below in connection with FIG. 5.

Since the period (T) of the user's exercise routine may change during the exercise session, various alternatives for determining the period (T) of the desired cadence are possible. For example, the period (T) of the exercise routine could be determined periodically and the steps of FIG. 4 could periodically update the desired cadence. Alternatively, some average period (T) determined at several points throughout the exercise routine may be used to determine the desired cadence. In yet another embodiment, the period (T) of the exercise routine could be averaged over a sliding time window and that average could be used to determine the desired cadence.

Figure 5:
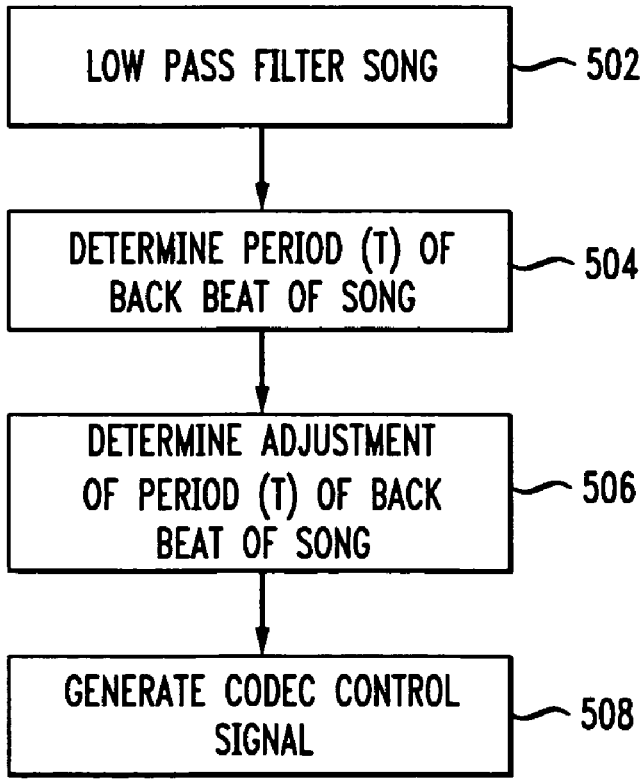
FIG. 5 is a flowchart showing the steps performed in order to adjust a song so that its cadence matches the desired cadence.

FIG. 5 is a flowchart showing the steps performed in order to adjust a song so that its cadence matches the desired cadence. For example, the song may be a song from the playlist 204. First, in step 502, the song is low pass filtered using low pass filter 310. This low pass filtering is performed in the digital domain using the digital representation of the song. The low pass filter removes the high frequency content of the song, with the residual low frequency content being output from the low pass filter 310.

The output of the low pass filter 310 is provided to the period determination circuit 312. In step 504, the period determination circuit 312 uses the output of the low pass filter 310 in order to determine the period (T) of the back beat of the song. One method for determining the period (T) is by counting clock cycles between adjacent peaks of the signal received from the low pass filter. This period (T) is indicative of the cadence of the song.

The period (T) of the song is received by the period adjustment circuit 314 from the period determination circuit 312. The desired period (T) of the desired cadence is received by the period adjustment circuit 314 from the buffer memory 316. Next, in step 506, the period adjustment circuit 314 determines an adjustment of the period (T) of the back beat of the song. This adjustment is the adjustment necessary to the period (T) of the back beat of the song so that it matches the period (T) of the desired cadence. This adjustment is determined as described above in connection with FIG. 1.

In one embodiment, the adjustment may be calculated as follows.

$$CS = \text{FLOOR}\left[\frac{\left(\frac{1}{BPM_1} - \frac{1}{BPM_2}\right)}{\frac{1}{CLK}}\right]$$

In the above equation, CS represents the cycle slips, which is the number of clock periods to be interpolated or decimated per second. If CS is positive, interpolation will be performed. If CS is negative, decimation will be performed. CLK is the clock rate of the CODEC in Hz. $BPM_1$ represents the beats per minute of the desired cadence and $BPM_2$ represents the beats per minute of the song. Floor(x) represents the mathematical function that returns the greatest integer less than or equal to x.

As an example, assume the following values:

$BPM_1$=60 $BPM_2$=65 CLK=20KHz $T_1$=1/$BPM_1$=16.666 mS $T_2$=1/$BPM_2$=15.38 mS; 1/CLK=0.05 mS

Using the above equation, Cycle Slips (CS)=0.00128 mS/0.05 mS=Floor [25.6]=25. Since the result is a positive number, interpolation will be performed. Spaced across 1 second, 25 clock cycles will be inserted to slow 65 BPM down to 60 BPM.

After the necessary adjustment is calculated in step 506, in step 508 the period adjustment circuit 314 generates a CODEC control signal 318 which is provided to the CODEC 306. The CODEC 306 adjusts the period (T) of the song as specified by the control signal 318. More particularly, the CODEC 306 receives the digital representation of the song from memory 302 and either interpolates or decimates the digital representation based on the control signal 318. The interpolation or decimation is performed as described above. The output of the CODEC 306 is then provided to the audio amplifier 308 for generation of the analog audio signal to be output to the user of the audio device 300.

The CODEC 306 continues to adjust the period (T) of the song based on the control signal 318 received from the period adjustment circuit 314. In an advantageous embodiment, the audio device 300 may perform mid-song corrections to the cadence of the songs. This is advantageous since the period (T) of the back beat of a song may be different at different points throughout the song. Thus, the steps of FIG. 5 may be performed periodically during the playing of each of the subsequent songs to allow for corrections to the control signal 318 at different points in the song. In one embodiment, the steps of FIG. 5 are performed continuously during the playing of each of the songs, and the control signal 318 is continuously updated to perform corrections to the period (T) of the back beat of the songs.

One skilled in the art will recognize the relationship and balance between how often the desired cadence is determined (FIG. 4) and how often the cadence of a song is adjusted (FIG. 5).

In certain embodiments, the cadence adjustment of songs may be encoded into the digital representation of the songs. For example, an indication of whether a song should receive cadence adjustment, could be encoded into the digital representation (e.g., header) of the song itself. In such a case, the circuitry of the audio device would be modified to recognize these headers, and to perform the steps of FIG. 5 based on this encoding.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. An apparatus for adjusting the cadence of played songs comprising:

a desired cadence determination circuit for determining a desired cadence based on received cadence data;

a period determination circuit for determining a period of a back beat of at least one song;

a period adjustment circuit for receiving said period of the back beat of said at least one song and said desired cadence, and determining a period adjustment signal based on the period of the back beat of said at least one song and said desired cadence; and a CODEC for receiving said adjustment signal and said digital representation of said at least one song and adjusting the cadence of said at least one song based on said period adjustment signal;

wherein the cadence is adjusted by an amount determined as a function of said period of the back beat of said at least one song, said desired cadence and a clock rate of the CODEC.

2. The apparatus of claim 1 wherein said period adjustment signal specifies interpolation of a digital representation of said at least one song in order to increase said period of the back beat of said at least one song.

3. The apparatus of claim 1 wherein said period adjustment signal specifies decimation of a digital representation of said at least one song in order to decrease said period of the back beat of said at least one song.

4. The apparatus of claim 1 wherein said amount is calculated at least in part by dividing a difference between the period of the back beat of said at least one song and the desired cadence by a reciprocal of said clock rate.

5. The apparatus of claim 1 further comprising a memory for storing digital representations of songs.

6. The apparatus of claim 1 further comprising a low pass filter for receiving a digital representation of at least one song and generating a signal received by the period determination circuit.

7. A personal audio device comprising the apparatus of claim 1.

8. A method for adjusting the cadence of played songs, the method comprising the steps of:

determining a desired cadence based on received cadence data;

determining a period of a back beat of at least one song;

determining a period adjustment signal based on the period of the back beat of said at least one song and said desired cadence; and adjusting the cadence of said at least one song based on said period adjustment signal;

wherein the cadence is adjusted by an amount determined as a function of said period of the back beat of said at least one song, said desired cadence and a clock rate of a CODEC.

9. The method of claim 8 wherein the adjusting step is performed by the CODEC.

10. The method of claim 8 wherein said period adjustment signal specifies interpolation of a digital representation of said at least one song in order to increase said period of the back beat of said at least one song.

11. The method of claim 8 wherein said period adjustment signal specifies decimation of a digital representation of said at least one song in order to decrease said period of the back beat of said at least one song.

12. The method of claim 8 wherein said amount is calculated at least in part by dividing a difference between the period of the back beat of said at least one song and the desired cadence by a reciprocal of said clock rate.

13. The method of claim 8 wherein said cadence data is received from a sensor associated with a user's shoe.

14. The method of claim 8 wherein said cadence data is received from a sensor integrated in an exercise machine.

15. The method of claim 8 wherein the desired cadence is an actual cadence of the user.

16. The method of claim 8 wherein the desired cadence is a multiple of an actual cadence of the user.

17. The method of claim 8 wherein the desired cadence is a factor of an actual cadence of the user.

18. The method of claim 8 wherein determining the desired cadence comprises measuring an actual cadence at a plurality of times and averaging the measured actual cadences.

19. The method of claim 8 wherein determining the desired cadence comprises measuring an actual cadence over a sliding time window and averaging the measured actual cadences.

20. The method of claim 8 wherein the desired cadence is periodically updated.

* * * * *